US007892118B1

(12) United States Patent
Kenley

(10) Patent No.: US 7,892,118 B1
(45) Date of Patent: Feb. 22, 2011

(54) BASKETBALL GOAL

(76) Inventor: Lyn Kenley, 524 N. Spillway Rd., Farmerville, LA (US) 71241

( * ) Notice: Subject to any disclaimer, the term of this patent is extended or adjusted under 35 U.S.C. 154(b) by 182 days.

(21) Appl. No.: 12/339,372

(22) Filed: Dec. 19, 2008

Related U.S. Application Data

(60) Provisional application No. 61/014,784, filed on Dec. 19, 2007.

(51) Int. Cl.
*A63B 63/00* (2006.01)
*A63B 63/08* (2006.01)

(52) U.S. Cl. ..... 473/483; 473/479; 473/486

(58) Field of Classification Search ..... 473/415, 473/480, 481, 482, 483, 484, 479
See application file for complete search history.

(56) References Cited

U.S. PATENT DOCUMENTS

| | | | |
|---|---|---|---|
| 1,767,424 | A | 6/1930 | Applegate |
| 4,151,989 | A | 5/1979 | Dittrich |
| 4,266,763 | A | 5/1981 | Collins |
| 4,465,277 | A | 8/1984 | Dittrich |
| 4,738,448 | A | 4/1988 | Liester |
| 5,800,295 | A | 9/1998 | Rogitz |
| 6,984,129 | B1 | 1/2006 | Jordan |
| 2006/0240916 | A1 | 10/2006 | Montie et al. |

*Primary Examiner*—Gene Kim
*Assistant Examiner*—M Chambers
(74) *Attorney, Agent, or Firm*—Garvey, Smith, Nehrbass & North, L.L.C.; Seth M. Nehrbass; Charles C. Garvey, Jr.

(57) ABSTRACT

A basketball goal provides a support that has upper and lower end portions. A backboard is affixed to the upper end portion of the support. A hoop or rim is affixed to the backboard. A jacking mechanism elevates the hoop when the hoop pivots downwardly when a player dunks a basketball through the hoop or rim. In such a case, the player typically contacts the rim or hoop with his or her hands or hand forcing it downwardly. With each such dunk shot, the rim or hoop is deflected downwardly and the jacking mechanism elevates the hoop about half an inch. A control positioned on the support enables the hoop to be selectively used in the jacking mode or in a fixed mode wherein the hoop or rim is affixed to a selected position in a selected elevation thus overriding the jacking mechanism. The control has multiple selectable positions including a position that engages the jacking mechanism and a fixed position that overrides the jacking mechanism. A third mode can be optionally provided that lowers the hoop or rim when the control is placed in the third, lowering position.

8 Claims, 6 Drawing Sheets

BASKETBALL GOAL

CROSS-REFERENCE TO RELATED APPLICATIONS

Priority of my U.S. Provisional Patent Application Ser. No. 61/014,784, filed Dec. 19, 2007, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to basketball goals. More particularly, the present invention relates to an improved basketball goal that employs a specially configured mechanism that elevates the circular hoop or rim part of the goal (and preferably the backboard assembly) each time a player dunks a basketball through the hoop or rim and displaces the hoop or rim downwardly.

2. General Background of the Invention

Basketball was invented by Dr. James Naismith in Springfield Mass. in 1891. Bob Kurland has been credited with the first dunk shot to be performed in an official game around 1942. Since that time, the dunk shot or slam dunk, has steadily grown in reputation for being the most exciting and intimidating singular performance in basketball. Anyone who has ever played the game has dreamed of having the ability to perform the slam dunk, however, most were unable to realize it. This changed with the first adjustable height basketball goals. Now we can all dunk, (well, almost).

In general, adjustable height basketball goals have been known for years. The design of these goals incorporates many different mechanisms including crank screws, adjusting arms, and other devices to accomplish the height adjustment. There are models that even require the player to stand underneath the goal and push it into position with a broom handle. While a few of these adjustable goals function quite well, all of them, however, have one common disadvantage. The player must stop playing in order to change the height of the basketball goal. This interruption is distracting and often the change in goal height is too large and inaccurate.

The following U.S. patents are incorporated herein by reference:

TABLE

| PAT. NO. | TITLE | ISSUE DATE |
|---|---|---|
| 1,767,424 | Educational Game Apparatus | Jun. 24, 1930 |
| 4,151,989 | Basketball Practice Device | May 1, 1979 |
| 4,266,763 | Recreational Basketball Apparatus with Moving Backboards | May 12, 1981 |
| 4,465,277 | Basketball Goal Structure | Aug. 14, 1984 |
| 4,738,448 | Support Assembly for a Basketball Basket and Backboard | Apr. 19, 1988 |
| 5,800,295 | Automatically Lowering Basketball Hoop for Dunking | Sep. 1, 1998 |
| 6,984,129 | Educational Basketball Game Device and Method | Jan. 10, 2006 |

TABLE-continued

| PAT. NO. | TITLE | ISSUE DATE |
|---|---|---|
| 2006/0240916 | Method and System for Improving Basketball Shooting | Oct. 26, 2006 |

BRIEF SUMMARY OF THE INVENTION

The present invention provides a self-adjusting basketball goal system designed to increase the height of the hoop or rim (and preferably backboard assembly) each time the ball is slam dunked. With the apparatus of the present invention, the game is never interrupted and the change in height is small and can be consistent. No cranks, broom handles, or other device need be employed to elevate the hoop or rim and backboard assembly.

The apparatus of the present invention is a self-adjusting basketball goal system which adjusts the height of the goal assembly each time the basketball is slam dunked. It requires no other actions to be performed by the player outside of playing the game itself. When a player executes a dunk shot, the player's hand or hands contact the rim of the goal usually applying considerable force to it.

The deformable goals (rims, hoops) seen today are a result of this action in an effort to prevent damage to the goal assemblies. The apparatus of the present invention utilizes this force through a pivoting rim assembly to actuate the lifting, or jacking, mechanism which raises the height of the entire goal assembly by a height of half an inch.

The height can be adjusted so that inexperienced, younger, or even handicapped players can play the game. Often though, the main reason for lowering the goal is simply to enable more players to dunk the basketball. Once players have played using the goal at a given height, the goal is usually raised in order to increase the challenge. However, with many of the adjustable goals on the market, the change to the next height increment is too great, rendering the goal out of reach and defeating the purpose of adjustability. In the case of infinitely adjustable goals, the change can be inaccurate or difficult to achieve a consistent increase in height.

In comparison to other adjustable height basketball goals, the apparatus of the present invention height adjustment is automatic when dunking. The change can be small such as only half an inch for each and every dunk shot. The height increase can be small, accurate, and consistent. This small change goes virtually unnoticed while play continues without interruption. As play continues, however, the change becomes more apparent as the difficulty gradually increases. This induces a training effect by increasing resistance for the player which is another advantage of the system. The apparatus of the present invention has a range of movement of about two feet. This equates to twenty four inches or forty eight dunk shots before the maximum is reached, quite a workout for any player.

Once the maximum height for the system is reached, play can continue as normal or the goal can be lowered to its lowest setting or any height in between by means of the selector control located on the rear of the main support tube. The selector control can be a small lever which controls the mode that the system is in. The apparatus of the present invention has three modes: jacking mode, stationary mode, and lower mode. In jacking mode, the apparatus of the present invention will raise its position by half an inch each time the ball is dunked until it reaches its maximum height. If a dunk shot is not performed, the apparatus of the present invention will play normally and will remain stationary.

In stationary mode, the apparatus of the present invention will play as any other basketball goal and maintain its position regardless of shot type even when a dunk shot is performed. In lower mode, the apparatus of the present invention will decrease in height by force of gravity until the selector control lever is released or it reaches its minimum height. The versatility of the apparatus of the present invention allows it to accommodate many different forms of basketball. A traditional game can be played normally or the jacking feature can be incorporated as an exciting alternative.

The apparatus of the present invention can be used as an effective training device for those seeking to improve their games. The apparatus of the present invention is simply more fun, providing hours of enjoyment with a unique twist.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
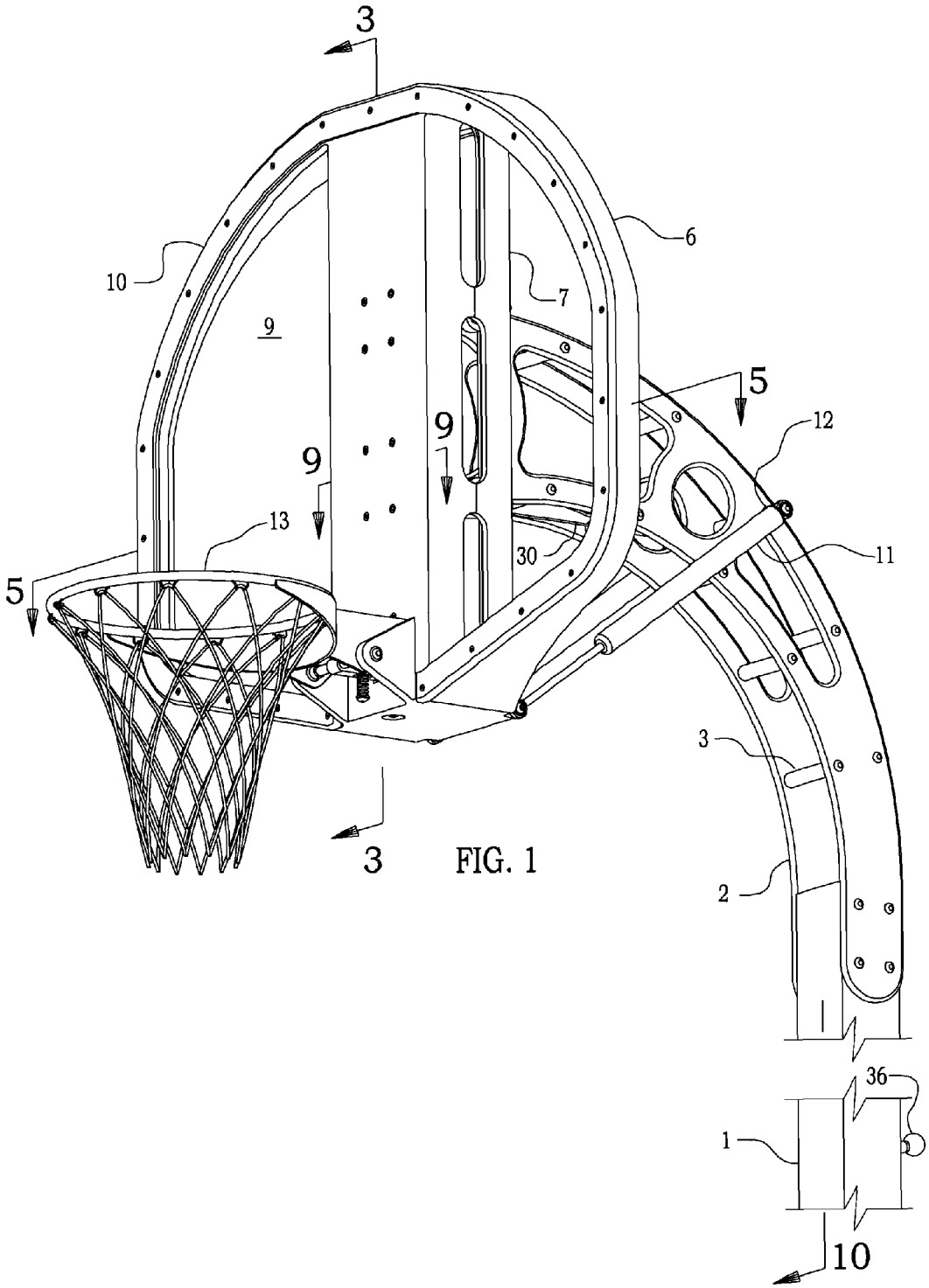
FIG. 1 is a front perspective view of the preferred embodiment of the apparatus of the present invention.
Figure 2:
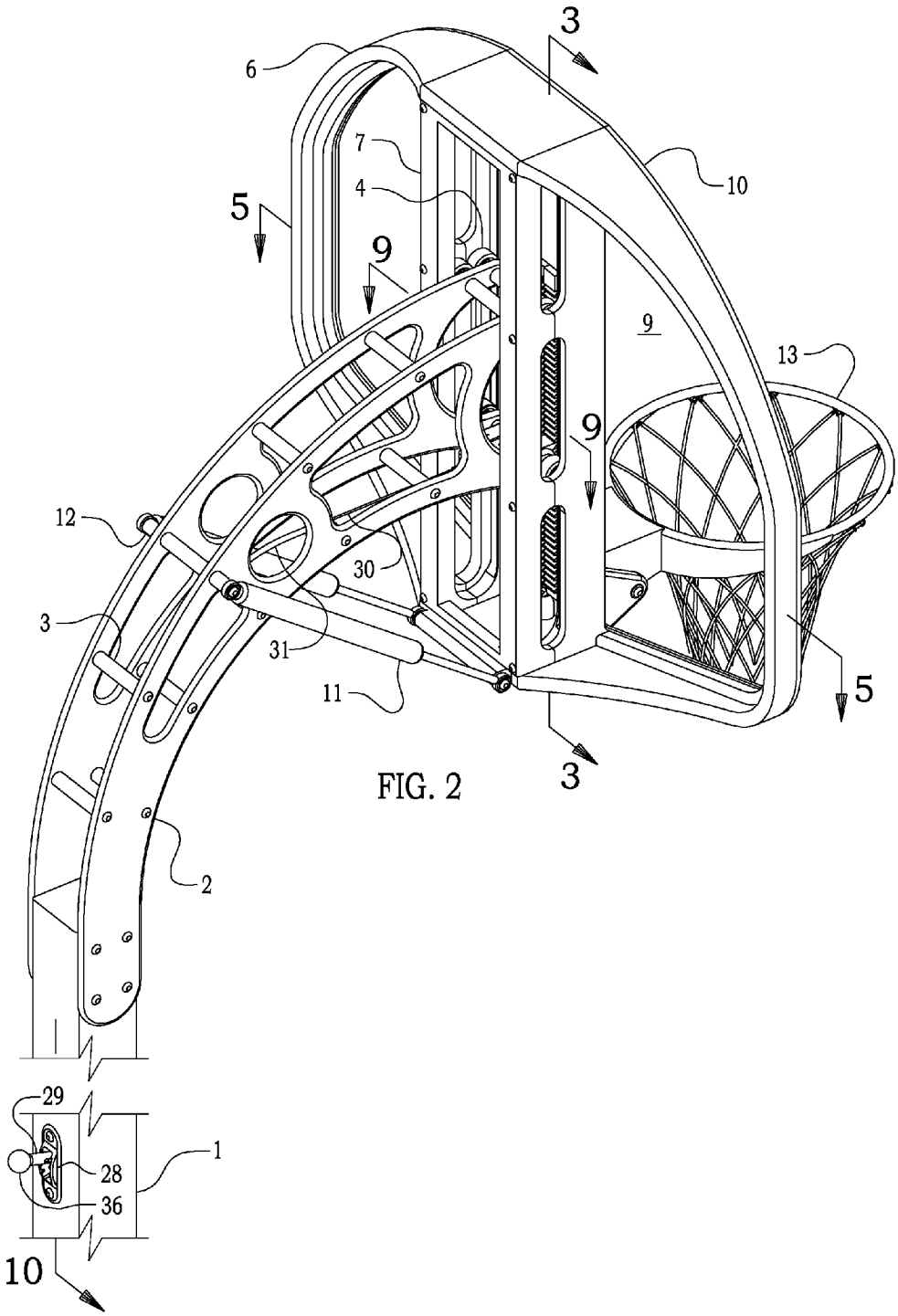
FIG. 2 is a rear perspective view of the preferred embodiment of the apparatus of the present invention.
Figure 3:
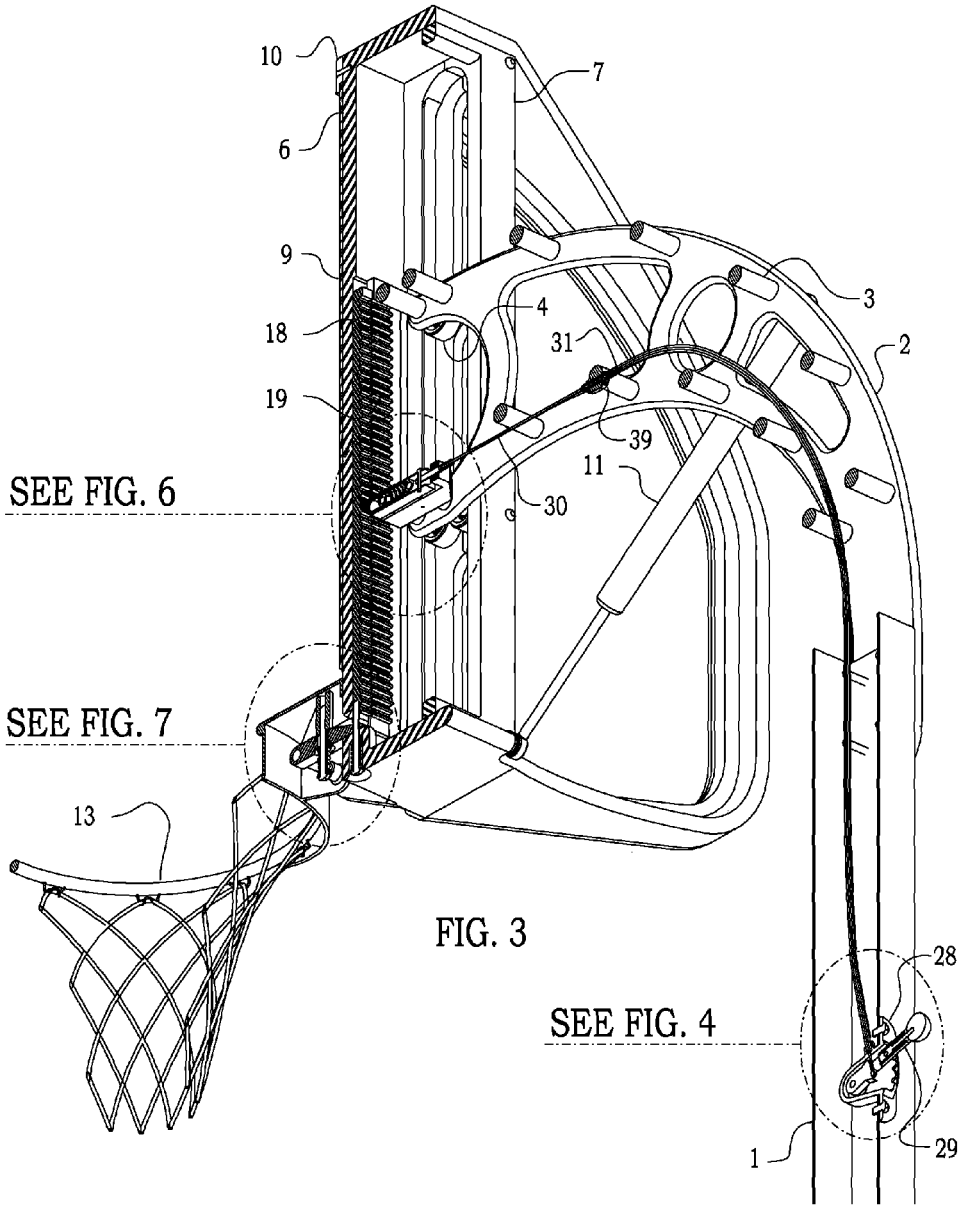
FIG. 3 is a side sectional view of the preferred embodiment of the apparatus of the present invention.
Figure 4:
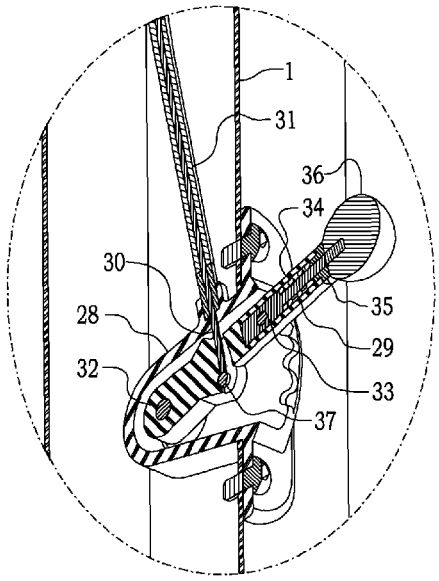
FIG. 4 is a fragmentary view of the preferred embodiment of the apparatus of the present invention.
Figure 5:
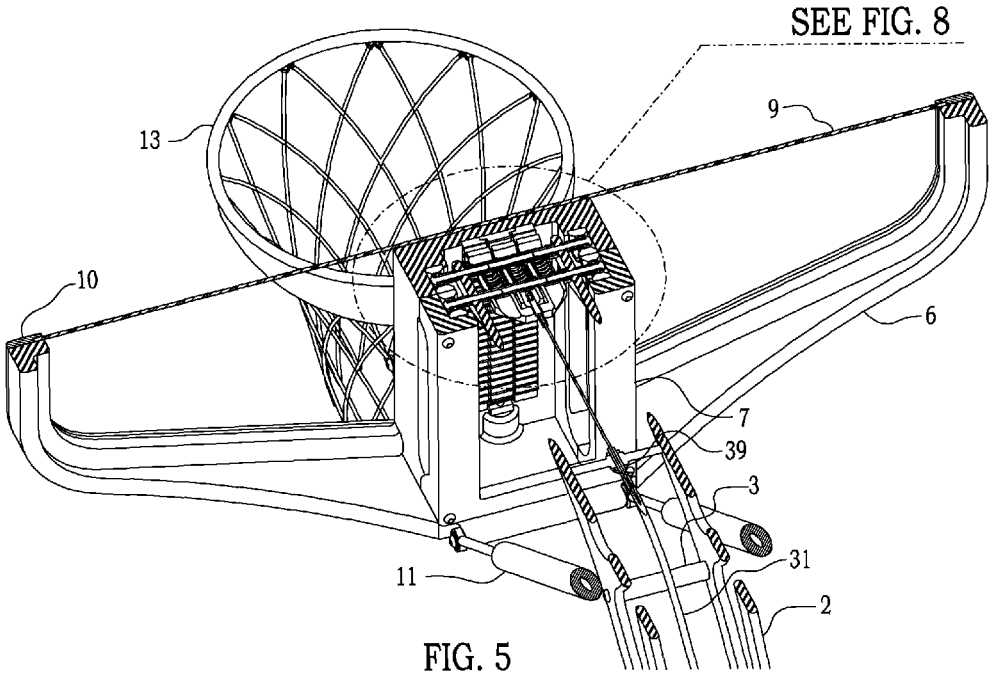
FIG. 5 is a top, sectional view of the preferred embodiment of the apparatus of the present invention.
Figure 6:
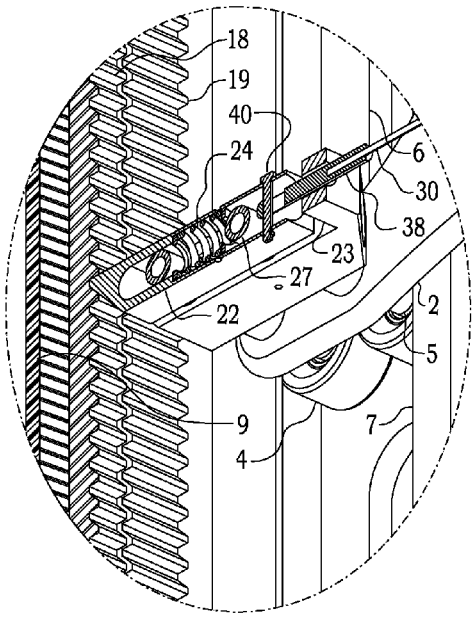
FIG. 6 is a fragmentary cutaway view of the preferred embodiment of the apparatus of the present invention.
Figure 7:
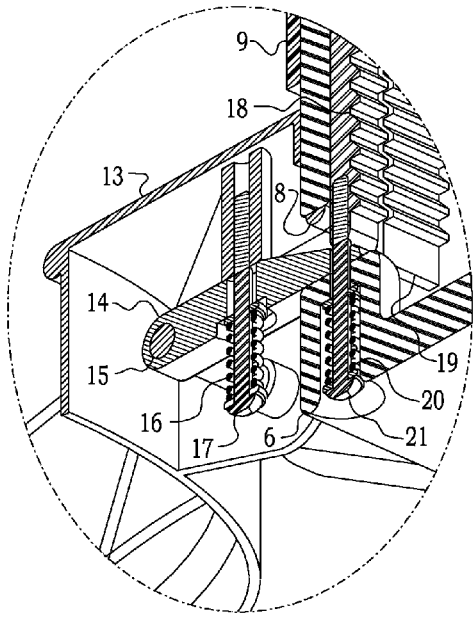
FIG. 7 is a fragmentary cutaway view of the preferred embodiment of the apparatus of the present invention.
Figure 8:
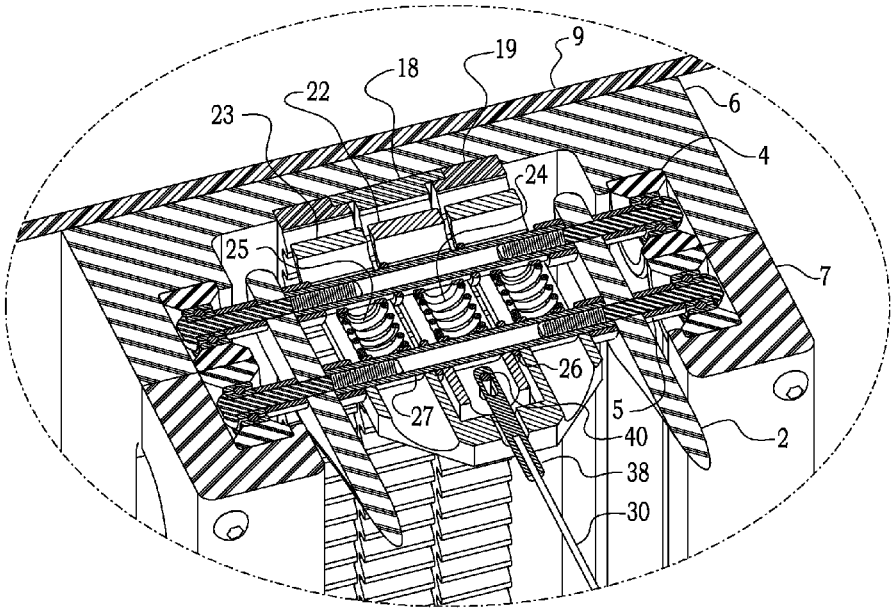
FIG. 8 is a fragmentary cutaway view of the preferred embodiment of the apparatus of the present invention.
Figure 9A:
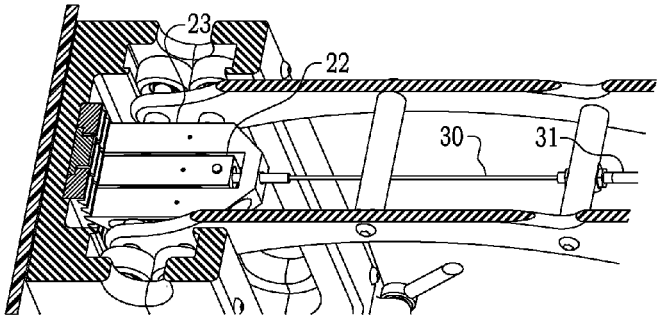
FIGS. 9*a*, 9*b*, 9*c* are fragmentary views of the preferred embodiment of the apparatus of the present invention.
Figure 10A:
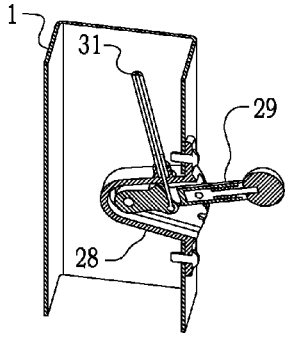
FIGS. 10*a*, 10*b*, 10*c* are fragmentary views of the preferred embodiment of the apparatus of the present invention.
Figure 9B:
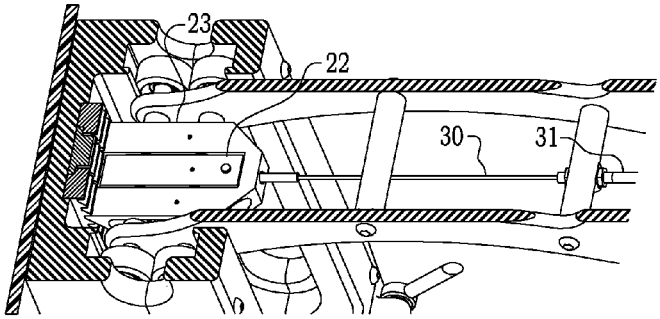
Figure 10B:
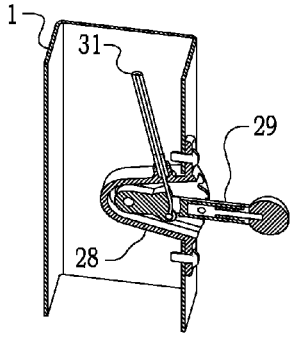
Figure 9C:
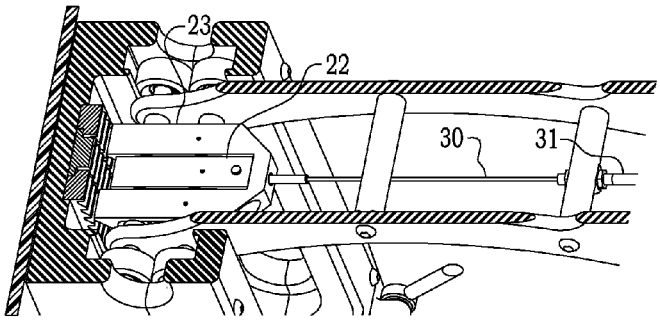
Figure 10C:
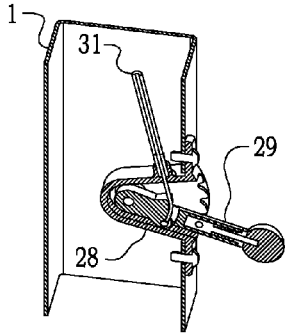

FIGS. 1-8, 9*a*, 9*b*, 9*c*, 10*a*, 10*b*, 10*c* show the preferred embodiment of the apparatus of the present invention, designated generally by the numeral 50. The apparatus 50 of the present invention is supported from the ground by the main tube 1. The main tube 1 is attached to two goal support arms 2 secured to opposite sides of the main tube 1. The goal support arms 2 are held together by twelve goal support arm spacers 3 and two pawl axles 27. Located on a wide end of the goal support arms 2 are four pairs of rollers 4 attached to the outside top and bottom of the goal support arms 2. Clearance is provided between the goal support arms 2 and the rollers 4 by a plurality of preferably eight (8) roller spacers 5.

The front backboard frame 6 and the rear backboard frame 7 are mated together capturing the four pairs of rollers 4 attached to the goal support arms 2. Both the front backboard frame 6 and the rear backboard frame 7 are equipped with two tracks in which the paired rollers 4 will travel. A small opening is located in the lower front portion of the front backboard frame 6 through which the jack arm 14, discussed later, will pass. A crush block 8 is attached to the top of this opening. The backboard 9 is captured between the front backboard frame 6 and the backboard retainer 10.

The apparatus of the present invention is equipped with two dampers 11. One end of each damper 11 is attached to the outside of each goal support arm 2 with clearance provided by two damper spacers 12. The other end of each damper 11 is attached to the base of the front backboard frame 6.

Rim 13 can be a regulation eighteen inch (18") gusseted ring attached to a mount containing a threaded and gusseted tube attached to the underside of the mount. The jack arm 14 is placed on rim axle 15 on which jack arm 14 is allowed to freely rotate. The rim axle 15 and jack arm 14 are then fitted into the rim 13 mount. The rim 13 is then attached to the front backboard frame 6 with the jack arm 14 inserted into an opening in the front backboard frame 6. The overload spring 16 is placed onto the overload spring screw 17 which then passes through a slotted hole in the jack arm 14 and threaded into the rim 13 at the threaded tube.

The apparatus 50 of the present invention is equipped with two rack gears: the jack rack gear 18 and the stationary rack gear 19. The stationary rack gear 19 is actually two rack gears that are attached to the inside of the front backboard frame 6. The jack rack gear 18 is fitted between the two stationary rack gears 19 and is captured by means of a slot formed between the front backboard frame 6 and the two stationary rack gears 19 and is allowed to freely slide up and down. The jack spring 20 is placed onto the jack spring screw 21 which then passes through a hole in the bottom of the front backboard frame 06 and threaded into the bottom of the jack rack gear 18.

The apparatus 50 of the present invention is equipped with two pawls: the jack pawl 22 and the U-shaped stationary pawl 23. The jack pawl spring 24 is fitted into a hole in the rear of the jack pawl 22 and two stationary pawl springs 25 are fitted into the rear of the stationary pawl 23. The jack pawl 22 is then fitted into the center of the stationary pawl 23 with clearance provided by four jack pawl spacers 26 allowing both pawls to move independently. Both pawls have a slotted hole through which two pawl axles 27 pass. Both the jack pawl spring 24 and the stationary pawl springs 25 are captured by the rear pawl axle 27.

The selector control is attached to the rear of the main tube 1 and consists of the selector control housing 28 and the selector control lever 29. The selector control lever 29 is equipped with a spring loaded pin which engages one of three position notches in the selector control housing 28 (see FIGS. 10*a*, 10*b*, 10*c*). Each position notch correlates to one of the three modes that the system is capable of. The selector control lever 29 is attached to one end of the control cable 30. The other end of the control cable 30 is attached to the jack pawl 22.

The selector control is attached to the rear of the main tube 1 by the selector control housing 28. Contained within the selector control housing 28 is the selector control lever 29, which is retained by the selector control lever axle 32. Within the selector control lever 29 are the selector control pin 33 and the selector control pin spring 34, which are retained by the selector control pin retainer 35. The portion of the selector control pin 33 opposite the selector control lever axle 32 is threaded and passes thru a hole in the selector control pin retainer 35 and is threaded into the selector control lever knob 36. The selector control pin 33 engages one of three position notches in the selector control housing 28. Each position notch correlates to one of the three modes the system is capable of (see FIGS. 10*a*, 10*b*, 10*c*). The selector control lever 29 is attached to a control cable 30 by a barrel cable end 37. The opposite end of the control cable 30 passes thru the control cable housing 31, which is captured by the selector control housing 28 and a barrel cable adjuster 39 attached to one of the goal support arm spacers 3. This end of the control cable 30 is fitted with a rod cable end 38 that passes thru an enlarged hole in the rear of the stationary pawl 23. The rod cable end 38 is then attached to the jack pawl 22 by a clevis pin 40.

The apparatus 50 of the present invention has three modes of function, each controlled by the selector control lever 29. The players have the choice of any of these modes at any time they choose regardless of the position of the goal assembly.

When the selector control lever 29 is in its top position, the system is in the jack mode. The apparatus 50 of the present invention will play as a normal basketball goal with the added benefit of increasing its height by half an inch each time the basketball is dunked and rim 13 pivoted downwardly. The jack cycle begins with the goal assembly being held in place by the stationary pawl 23 which is engaged into the stationary rack gear 19 attached to the front backboard frame 6. A player performing a dunk shot must put downward pressure on the rim 13. The rim 13 must rotate eight degrees resulting in the outermost point of the rim 13 moving downward about three inches. This is not an unusual result of a dunk shot and is required for the jack to occur. The rotation of the rim 13 around rim axle 15 causes the jack arm 14, which is held in place by the overload spring 16 and overload screw 17, to rotate. The jack arm 14 then pushes the jack rack gear 18 upward resulting in the jack spring screw 21 compressing the jack spring 20 against the bottom of the front backboard frame 6. At the same time, the jack rack gear 18 pushes the jack pawl 22 rearward compressing the jack pawl spring 24 against the rear pawl axle 27 until the eight degree rotation of the rim 13 is completed. The jack pawl 22 is then pushed forward by the jack pawl spring 24 re-engaging the jack rack gear 18. The jack arm 14, having now completed its movement, is prevented from further rotation by coming into contact with the crush block 8 located at the top of the opening in the front backboard frame 6 through which the jack arm 14 passes. At this point, the overload spring 16 will begin to be compressed by the overload spring screw 17 against the jack arm 14 to absorb any additional force applied to the rim 13. The dampers 11 attached to the front backboard frame 6 and the goal support arms 2 also absorb the impact from the shot. The player, dunk shot successfully completed, now releases the rim 13. Once released, the overload spring 16 now relaxes, returning the rim 13 to the jack arm 14. The jack spring 20 then pushes upward on the front backboard frame 6 away from jack spring screw 21, which is threaded into the jack rack gear 18, which is held in place by the jack pawl 22. The stationary rack gear 18, which is rigidly attached to the front backboard frame 6, also moves upward pushing the stationary pawl 23 rearward compressing the stationary pawl spring 25 against the rear pawl axle 27 until the rim 13 returns to its original position.

The stationary pawl 23 then re-engages the stationary rack gear 18 and the jack cycle is now complete. The cycle will repeat after each dunk shot or until the goal reaches its maximum position. The spring rates of both the jack spring 20 and the overload spring 16 are adjustable via the jack spring screw 21 and the overload spring screws 17. Also, the springs 16 & 20 can also be replaced with others having more appropriate load ratings.

When the selector control lever 29 is in the center position, the system 50 is in stationary mode. By pulling the selector control lever knob 36, the selector control pin 33 compresses the selector control pin spring 34 against the selector control pin retainer 35 and disengages the selector control pin 33 from the top position in the selector control housing 28. The selector control lever 29 can then be rotated downward. The selector control lever 29 pulls the control cable 30, which in turn pulls the jack pawl 22, disengaging it from the jack rack 18. The selector control lever knob 36 is then released allowing the selector control pin 33 to engage the center position in the selector control housing 28. The apparatus 50 of the present invention will play as a normal basketball goal and will remain at a constant height determined by when this mode was selected. The jacking feature is now disabled. The goal 13 is held in place by the stationary pawl 23 which is engaged into the stationary rack gear 19 attached to the front backboard frame 6. Moving the selector control lever back to the top position relaxes the control cable, which in turn reengages the jack pawl into the jack rack, and restores the jacking feature.

When the selector control lever is in the bottom position, the system is in lower mode. By pulling the selector control lever knob, the selector control pin compresses the selector control pin spring against the selector control pin retainer and disengages the selector control pin from the center position in the selector control housing. The selector control lever can then be rotated downward. The selector control lever pulls the control cable, which in turn pulls the jack pawl, which in turn pulls the stationary pawl, disengaging it from the stationary rack. The selector control lever knob can then be released allowing the selector control pin to engage the bottom position in the selector control housing. The goal begins to lower by force of gravity with the dampers controlling its decent. The apparatus of the present invention will continue lowering until the selector control lever is returned to another position or until the goal reaches its minimum height.

When the selector control lever is in the center position, the system 50 is in stationary mode. The apparatus 50 of the present invention will play as a normal basketball goal and will remain at a constant height determined by when this mode was selected. The jacking feature is now disabled. The goal 13 is held in place by the stationary pawl 23 which is engaged into the stationary rack gear 19 attached to the front backboard frame 6. Moving the selector control lever 29 to the center position pulls the control cable 30 which in turn pulls the jack pawl disengaging it from the jack rack gear 18.

When the selector control lever 29 is in the bottom position, the system 50 is in lower mode. The rim 13 will begin to lower and will continue until the selector lever 29 is returned to another position or until the goal 13 reaches its minimum position. Moving the selector control lever 29 to the lower position pulls the control cable 30 which in turn pulls the jack pawl 22 against the stationary pawl 23 disengaging it from the stationary rack gear 19. The goal 13 begins to lower by force of gravity with the dampers 11 controlling its decent. To stop the goal 13 at any position, simply return the control selector lever 29 to another mode.

The following is a list of parts and materials suitable for use in the present invention:

PARTS LIST

| Part Number | Description |
|---|---|
| 1 | main tube |
| 2 | goal support arms |
| 3 | goal support arm spacers |
| 4 | rollers |
| 5 | roller spacers |
| 6 | front backboard frame |

-continued

PARTS LIST

| Part Number | Description |
|---|---|
| 7 | rear backboard frame |
| 8 | crush block |
| 9 | backboard |
| 10 | backboard retainer |
| 11 | dampers |
| 12 | damper spacers |
| 13 | rim |
| 14 | jack arm |
| 15 | rim axle |
| 16 | overload spring |
| 17 | overload spring screw |
| 18 | jack rack gear |
| 19 | stationary rack gear |
| 20 | jack spring |
| 21 | jack spring screw |
| 22 | jack pawl |
| 23 | stationary pawl |
| 24 | jack pawl spring |
| 25 | stationary pawl spring |
| 26 | jack pawl spacer |
| 27 | pawl axle |
| 28 | selector control housing |
| 29 | selector control lever |
| 30 | control cable |
| 31 | control cable housing |
| 32 | selector control lever axle |
| 33 | selector control pin |
| 34 | selector control pin spring |
| 35 | selector control pin retainer |
| 36 | selector control lever knob |
| 37 | barrel cable end |
| 38 | rod cable end |
| 39 | barrel cable adjuster |
| 40 | clevis pin |
| 50 | basketball goal apparatus |

All measurements disclosed herein are at standard temperature and pressure, at sea level on Earth, unless indicated otherwise.

The foregoing embodiments are presented by way of example only; the scope of the present invention is to be limited only by the following claims.

The invention claimed is:

1. A basketball goal comprising:

a) a support that has upper and lower end portions;

b) a backboard affixed to the upper end portion of the support;

c) a hoop affixed to the backboard;

d) a jacking mechanism that includes a toothed rack and which elevates the hoop when the hoop pivots downwardly;

e) a control positioned on the support that enables the hoop to be selectively affixed at a selected elevation, overriding the jacking mechanism; and f) said control has three positions including the jacking position, a fixed position that disallows jacking and a lowering position that moves the hoop to a lower position having multiple selectable positions including a position that engages the jacking mechanism and a fixed position that overrides the jacking mechanism and wherein the jacking mechanism elevates the hoop a distance equal to the spacing of teeth on the rack each time the hoop is pivoted downwardly.

2. The basketball goal of claim 1 wherein the jacking mechanism includes a set of racks.

3. The basketball goal of claim 1 wherein the support includes a pair of plates that are spaced apart.

4. The basketball goal of claim 1 wherein the jacking mechanism includes a projection that engages the rack.

5. The basketball goal of claim 1 wherein the hoop and backboard assembly travels vertically a distance of between about ½ and 24 inches.

6. The basketball goal of claim 1 wherein the hoop moves between upper and lower positions, the lower position being at a position which allows at least one of the players to dunk.

7. The basketball goal of claim 1 wherein the control is a lever.

8. The basketball goal of claim 1 wherein the jacking mechanism lifts the backboard assembly.

* * * * *